United States Patent [19]

Tachibana et al.

[11] 4,432,212

[45] Feb. 21, 1984

[54] HERMETIC TURBO-REFRIGERATOR APPARATUS

[75] Inventors: Keiji Tachibana, Tokyo; Masatosi Terasaki, Ibaraki; Yoshihiko Nakayama, Ibaraki; Junichi Kaneko, Ibaraki, all of Japan

[73] Assignee: Hitachi, Ltd., Tokyo, Japan

[21] Appl. No.: 92,510

[22] Filed: Nov. 8, 1979

[30] Foreign Application Priority Data

Nov. 13, 1978 [JP] Japan ..... 53-138882

[51] Int. Cl.[3] ..... F25B 1/00; F04B 49/00

[52] U.S. Cl. ..... 62/229; 62/228.4; 74/375; 417/15

[58] Field of Search ..... 62/510, 126, 228.8, 62/323 C; 236/94; 417/15, 316, 223; 74/375

[56] References Cited

U.S. PATENT DOCUMENTS 1,834,790 12/1931 Logue ..... 74/375

2,979,917 4/1961 Meagher ..... 62/508 X 3,839,877 10/1974 Kramer ..... 62/126

4,295,792 10/1981 Tachibana et al. ..... 192/87.18

*Primary Examiner*—William E. Wayner

*Attorney, Agent, or Firm*—Antonelli, Terry & Wands

[57] ABSTRACT

In a turbo-refrigerator apparatus provided with a compressor in the form of a turbocompressor, a speed increasing gear system capable of switching from one speed increase ratio to another at least in two stages is located between the turbocompressor and an electric motor, so that a speed increase ratio suitable for the conditions of outdoor air can be selected to operate the apparatus with high efficiency. Housings of the turbocompressor, electric motor and speed increasing gear system are connected together in such a manner that a shaft supporting an impeller of the turbocompressor, an output shaft of the electric motor and shafts of the speed increasing gear system are located within the respective housings to render the apparatus hermetic to avoid extension of the rotary shafts through the housings, thereby avoiding leak of the working fluid of the turborefrigerator apparatus to outside.

12 Claims, 4 Drawing Figures

HERMETIC TURBO-REFRIGERATOR APPARATUS

BACKGROUND OF THE INVENTION

1. Field of the Invention

This invention relates to a hermetic turbo-refrigerator apparatus mainly used with an air-conditioning system installed in a building.

2. Description of the Prior Art

The prior art documents published prior to the filing of the original application (priority date) include Japanese Patent Publication No. 21332/74 (inventor, Shoji Ichikawa), Japanese Patent Publication No. 18942/77 (inventors, Akiichi Takata et al) and U.S. Ser. No. 937,806, now U.S. Pat. No. 4,295,792.

Japanese Patent Publication No. 21332/74 discloses a turbo-refrigerator apparatus comprising a turbocompressor, a motor for driving the turbocompressor, a condenser, a pressure-reducing valve, an evaporator and suction vanes, wherein the drive motor is in the form of a high-speed DC motor or a thyristor motor, and speed control means, such as resistance control means or thyristor chopper control means, is mounted between the motor and a DC power source. While operating in a cooling mode, an impeller of the turbocompressor has its number of revolutions controlled in such a manner that the number of revolutions is commensurate with the difference in temperature between brine at the outlet of the evaporator and cooling water at the inlet of the condenser. By controlling the number of revolutions of the impeller of the turbocompressor by following up differences in temperature between the cooling water and brine or changes in the temperature of cooling water as disclosed in this prior art document, it would be possible to minimize an input of power and to operate the turbocompressor at a low energy consumption level.

However, the use of a high-speed DC electric motor as a drive motor, a DC power source as a power source and resistance control means or thyristor chopper control means as speed control means involves an increase in capital cost because the equipment is complex in construction and large in size. Since the ordinary power source commercially available is an AC power source, it is necessary to use a DC-AC converter (electricaly operated DC generator) to provide a DC power source. This is one of the factors concerned in increased capital cost.

Disclosed in Japanese Patent Publication No. 18942/77 is a turbo-refrigerator apparatus comprising a turbocompressor, a prime mover, a condenser and a cooler, wherein speed regulating means for the prime mover and detector means for detecting the flow rate and temperature of cooling fluid in the condenser or the internal pressure of condenser are provided, the speed regulating means being controlled in accordance with the values detected by the detector means to thereby control the number of revolutions of the impeller of the turbocompessor. This prior art could achieve the same results as those achieved by Japanese Patent Publication No. 21332/74.

However, in Japanese Patent Publication No. 18942/77, it is stated that the prime mover may be in the form of a steam turbine or a high frequency electric motor. Thus an increase in capital cost could not be avoided whichever of the two might be selected. Generally, a steam turbine is low in efficiency, so that a system including the steam turbine would be low in efficiency as a whole even if the efficiency of the turbocompressor were increased by effecting control of the number of revolutions of its impeller.

In U.S. Pat. No. 4,295,792 a device for controlling operation of a fluid pressure raising system is proposed which includes at least a centrifugal compressor, a speed increasing gear system, an electric motor of constant speed and a detector for detecting atmospheric conditions or a discharge pressure, such device being operative to change the speed increase ratio of the speed increasing gear system in accordance with the value detected by the detector in controlling the number of revolutions of the impeller of the centrifugal compressor, to thereby increase the efficiency of the centrifugal compressor. The invention disclosed in the aforementioned U.S. patent offers the advantage that the capital cost is low because the equipment is simple in construction inasmuch as the number of revolutions of the impeller is controlled by the speed increasing gear system. However, since the centrifugal compressor, speed increasing gear system and electric motor are mounted independently of one another in open-type equipment, a difficulty would be encounted in providing a seal to portions of the housing through which the impeller shaft extends. Particularly, when the equipment in which the device is incorporated is a refrigerator apparatus, it is essential that no working fluid or a refrigerant, which generally belongs to a group of refrigerants bearing the name of Freon (trade name), be allowed to leak from the equipment. Thus, U.S. Pat. No. 4,295,792 would require an improvement for providing a satisfactory seal to the housing.

SUMMARY OF THE INVENTION

An object of this invention is to provide a turbo-refrigerator apparatus provided with means for effecting control of the number of revolutions of its compressor impeller with a simple construction.

Another object is to provide a turbo-refrigerator apparatus capable of wholly avoiding leak of a working fluid to outside.

Still another object is to provide a turbo-refrigerator apparatus involving low capital cost for effecting control of the number of revolutions of its compressor impeller.

A further object is to provide a turbo-refrigerator apparatus capable of operating with a high degree of efficiency.

In order to accomplish the aforesaid objects, the present invention provides a speed increasing gear system located between an output shaft of an electric motor driven by a commercially available AC power source and a shaft of an impeller of a turbocompressor, the speed increasing gear system being able to vary its speed increase ratio at least in two stages. The output shaft of the electric motor, an input shaft of the speed increasing gear system and an output shaft of the speed increasing gear system are connected to the impeller shaft of the turbocompressor within a respective housings in such a manner that none of the rotating shafts extend outwardly through the housings.

The advantages offered by the invention are as follows. Since control of the number of revolutions is effected by changing of gears of the speed increasing gear system, the end can be attained as desired by means of a mechanism of simple construction. None of the rotating shafts extend outwardly through the housings so that leak of the working fluid to outside can be avoided. Control of the number of revolutions of the impeller shaft is effected in accordance with changes in outdoor temperature, cooling water temperature or condensing pressure, and this is conducive to an increase in the efficiency with which the apparatus operates.

DESCRIPTION OF THE PREFERRED EMBODIMENT

Figure 1:
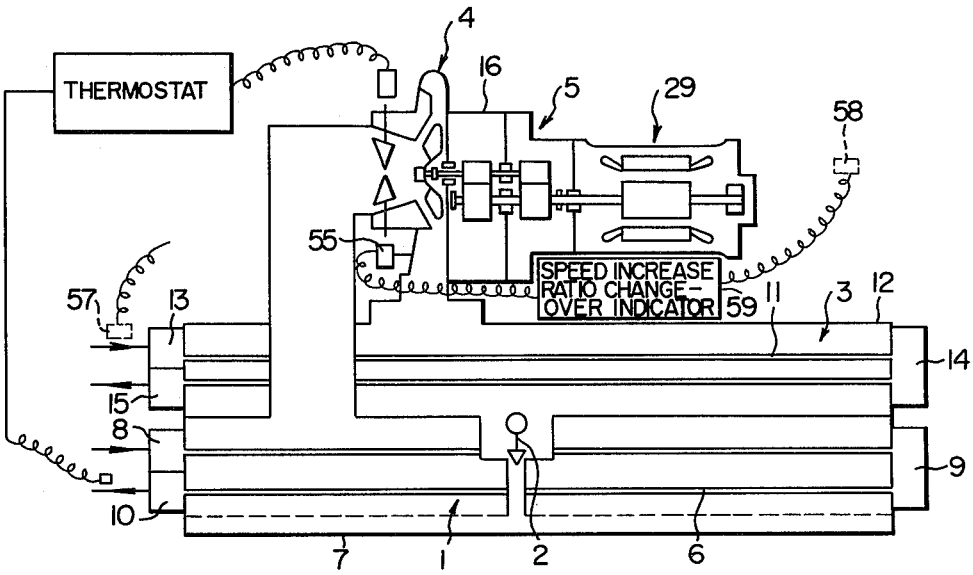
FIG. 1 is a schematic view of the apparatus comprising one embodiment of the present invention.

As shown in FIG. 1, the turbo-refrigerator apparatus of this embodiment comprises an electric motor generally designated by the reference numeral 29, a speed increasing gear system generally designated by the reference numeral 5, a turbocompressor generally designated by the reference numeral 4, a condenser 3, pressure reducing means 2 and an evaporator generally designated by the reference numeral 1.

The evaporator 1 includes heat transfer tubes 6 for a heated medium to pass therethrough while it is being cooled, a shell 7, an inlet header 8, a connecting header 9 and an outlet header 10. The heated medium to be cooled is introduced into the inlet header 8 and led, by way of one bundle of the heat transfer tubes 6, to the connecting head 9 from which it flows through the other bundle of the heat transfer tubes 6 to the outlet header 10, from which the cooled medium is supplied to various portions of the building where space cooling is required.

The condenser 3 includes heat transfer tubes 11, a shell 12, an inlet header 13, a connecting header 14 and an outlet header 15. Cooling water introduced into the inlet header 13 flows through one bundle of the heat transfer tubes 11 to the connecting header 14 from which it enters the other bundle of heat transfer tubes 11 and flows therethrough to the outlet header 15, from which the cooling water is supplied to a cooling tower.

The pressure reducing means 2 may be in the form of a float-type expansion valve. An orifice, heat sensitive expansion valve or the like may also be used as pressure reducing means 2.

Figure 2:
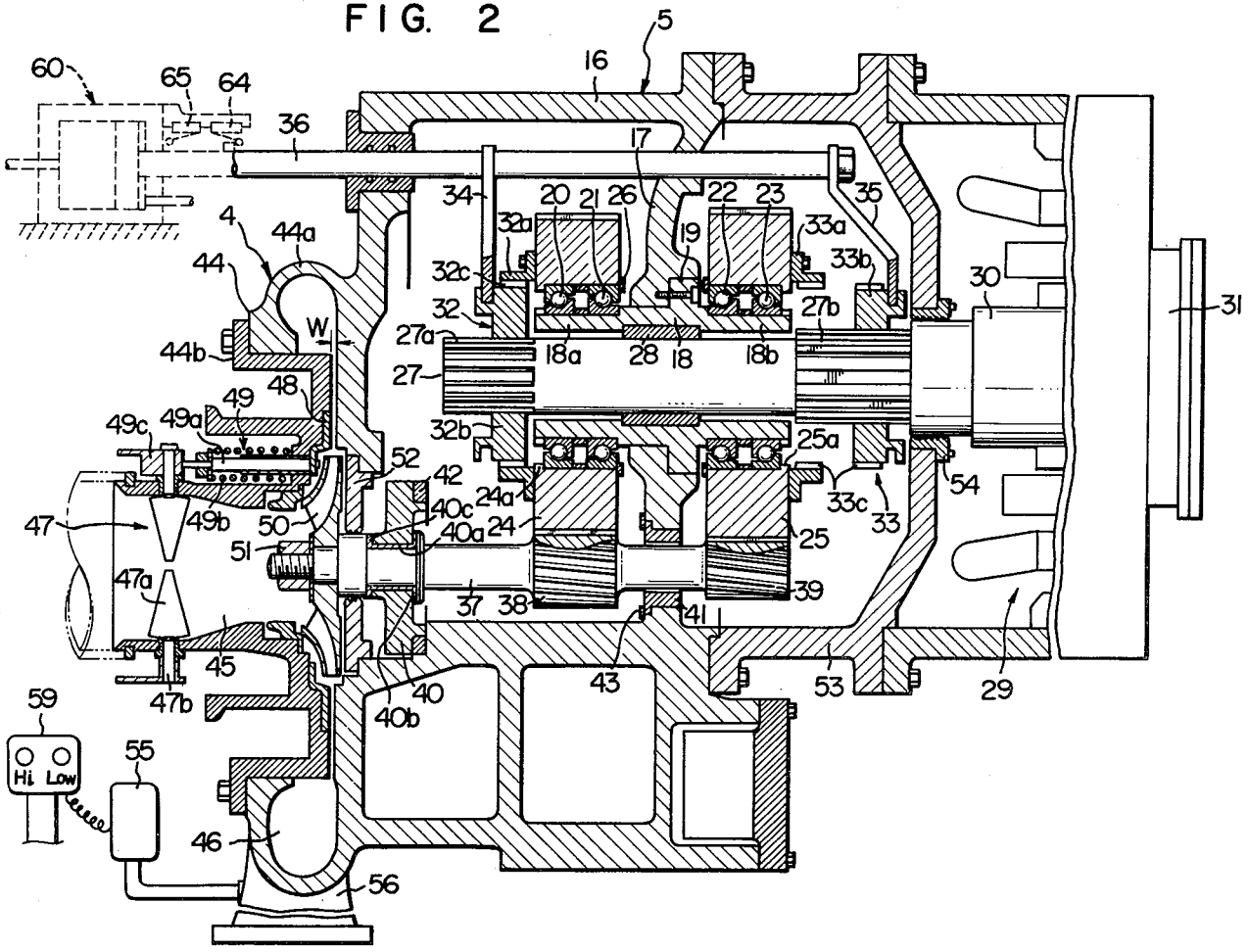
FIG. 2 is a sectional view showing in detail a portion of the apparatus shown in FIG. 1 which includes an electric motor, a speed increasing gear system and a turbocompressor.

As shown clearly in FIG. 2 the speed increasing gear system 5 includes gear box 16 having a bracket 17 mounted in its interior. The bracket 17 is shown as being formed integrally with the gear box 16 in one piece. However, the bracket 17 may be formed as a separate piece from the gear box 16 and unitarily connected thereto by bolts, welding, interfitting or any other suitable securing means. Although not shown in FIG. 2, the gear box 16 is formed with an opening for inserting into and withdrawing gears, to be described hereinafter, from the gear box 16.

A support member 18 is cylindrical in shape and has a flange 19 formed substantially midway of its length. The support member 18 is firmly bolted to the bracket 17. With the support member secured to the bracket 17, cylindrical portions 18*a* and 18*b* of the support member 18 extend in opposite directions from the bracket 17 in overhanging relation.

Ball bearings 20 and 21 are fitted to the outer periphery of the cylindrical portion 18*a* of the support member 18, and ball bearings 22 and 23 are fitted to the outer periphery of the cylindrical portion 18*b* thereof. These bearings 20, 21, 22 and 23 are all ball bearings that bear both radial and thrust loads.

A gear 24 is supported by the ball bearings 20 and 21, and a gear 25 is supported by the ball bearings 22 and 23. The gears 24 and 25 are secured to the ball bearings 20 and 21 and 22 and 23, respectively, in such a manner that an outer race of each gear is held between an inward projection 24*a* of 25*a* of gear 24 or 25 and a bearing support 36.

A low speed shaft 27 is received in a hollow portion of the support member 18 and supported by a Babbitt metal bearing 28 cast into the inner side of the support member 18. The low speed shaft 27 is an extension of an output shaft 30 of the electric motor 29 and unitary therewith. The output shaft 30 is journalled at its end by a bearing, not shown, mounted in a bearing chamber 31.

A click clutch generally designated by the reference numeral 32 including a pair of clutch portions 32*a* and 32*b* is mounted between the gear 24 and the low speed shaft 27, with one clutch portion 32*a* being firmly bolted to the gear 24 and the other clutch portion 32*b* being fitted in a spline 27*a* of the low speed shaft 27 for axial movement. The clutch portion 32*a* is formed at its inner side with teeth 32*c* adapted to come into and out of meshing engagement with teeth 32*c* formed at the outer side of the clutch portion 32*b*.

Another clutch generally designated by the reference numeral 33 including a pair of clutch portions 44*a* and 33*b* is mounted between the gear 25 and the low speed shaft 27, with one clutch portion 33*a* being firmly bolted to the gear 25 and the other clutch portion 33*b* being fitted in a spline 27*b* of the slow speed shaft 27 for axial movement. The clutch portion 33*a* is formed at its inner side with teeth 33*c* adapted to come into and out of meshing engagement with teeth 33*c* formed at the outer side of the clutch portion 33*b*.

The click clutches 32 and 33 may be replaced by other type of clutches, such as hydraulically actuated multi-plate clutches, without causing any change in the operation of the speed increasing gear system.

A shifter 34 is in engagement with the clutch portion 32*b* of click clutch 32, and another shifter 35 is in engagement with the clutch portion 33*b* of click clutch 33. The two shifters 34 and 35 are connected to an operating rod 36 extending at one end thereof outwardly of the gear box 16 and having a handle or other suitable actuator, not shown, fitted thereto.

A pinion shaft 37 supports two pinions 38 and 39 differing from each other in the number of teeth and is supported by bearings 40 and 41. The pinion 38 is in meshing engagement with the gear 24, and the pinion 39 is in meshing engagement with the gear 25.

The bearing 40 includes a Babbitt metal portion 40*a* for bearing radial loads, and Babbitt metal portions 40*b* and 40*c* for bearing thrust loads. The bearing 40 is firmly bolted to a ring 42 fixedly secured to the gear box 16. The bearing 41 consisting of two bearing portions is fitted in a bearing mounting hole formed in the bracket 17 and secured in place by a bearing support 43, after the pinion 39 has passed through the bearing mounting hole when the pinion 39 is assembled in the gear box 16.

The turbocompressor 4 is constructed as follows. A casing 44 is composed of a portion 44*a* integral with the gear box 16, and a portion firmly bolted to the portion 44*a*. The casing 44 defines therein a suction passage 45 and a vortex chamber 46.

An inlet guide vane assembly 47 including a plurality of segmental vanes 47*a* is mounted in the suction passage 45 with the vanes arranged radially. Each vane 47*a* is rotatably supported at its shaft portion 47*b* by the casing portion 44*b*. A movable diffuser 48 annular in shape is mounted at the exit side (diffuser section) of an impeller 50. The diffuser 48 which is designed to render the diffuser width W variable is supported for movement in a direction in which the width W is varied. A diffuser actuator assembly generally designated by the reference numeral 49 includes a rod 49*a* secured to the movable diffuser 48, a spring 49*b* exerting its biasing force on the rod 49*a* to move the diffuser 48 to maximize the diffuser width W (the condition shown in FIG. 2), and a cam 49*c* fitted to the shaft portion 47*b* of the inlet guide vane assembly. The diffuser actuator assembly 49 operates such that when the vanes 47*a* have rotated through a predetermined angle of rotation during their rotation in a direction in which they close the suction passage 45, the assembly 49 moves the movable diffuser 48 forwardly (moves the diffuser in a direction in which the diffuser width W is reduced), and that when the vanes 47*a* have rotated through a predetermined angle of rotation during their rotation in a direction in which they open the suction passage 45, the assembly 49 moves the movable diffuser 48 rearwardly (moves the diffuser 48 in a direction in which the diffuser width W is increased). The inlet guide vane assembly 47 is driven by known means and description of such means will be omitted.

The impeller 50 is secured to the end of the pinion shaft 37 by a nut 51.

A labyrinth seal 52 is firmly bolted to a portion of a side wall of the gear box 16 through which the pinion shaft 37 extends.

The electric motor 29 has an inner structure which is not different from that of a commercially available electric motor, and description of the inner structure will therefore be omitted. The electric motor 29 is firmly bolted toa distance or spacer piece 53 secured to the gear box 16. The distance piece 53 may be formed integrally with either the gear box 16 or the housing of the electric motor 29.

A labyrinth seal 54 is mounted in a portion of a wall of the distance piece 53 through which the output shaft 30 of the electric motor 29 extends.

A detector 55 is located in a passage connecting the vortex chamber 46 to the condenser 3 for detecting the internal pressure of a shell of the condenser 3. The internal pressure of the shell of the condenser 3 mostly varies in accordance with changes in the temperature of cooling water, the flow rate of cooling water or the outdoor temperature. Thus if the internal pressure of the shell of the condenser 3 is detected, then it is possible to detect any change that may occur in the temperature of cooling water, the flow rate of cooling water or the outdoor temperature. The same results can be achieved by substituting temperature detectors 57 and 58 (FIG. 1) for the detector 55 for detecting the temperature of cooling water and the outdoor temperature.

A speed increase ratio change-over indicator 59 connected to the detector 55 or temperature detectors 57 and 58 indicates that the speed increasing gear system 5 should be switched to a higher speed increase ratio when the pressure detected by the detector 55 is higher than a designed pressure level set beforehand and should be switched to a lower speed increase ratio when the pressure detected by the detector 55 is lower than the designed pressure level. Based on the indication given by the indicator, the operator switches the apparatus at the indicated speed increase ratio after temporarily interrupting the operation and restarts the apparatus at the indicated speed increase ratio following completion of switching.

Figure 3A:
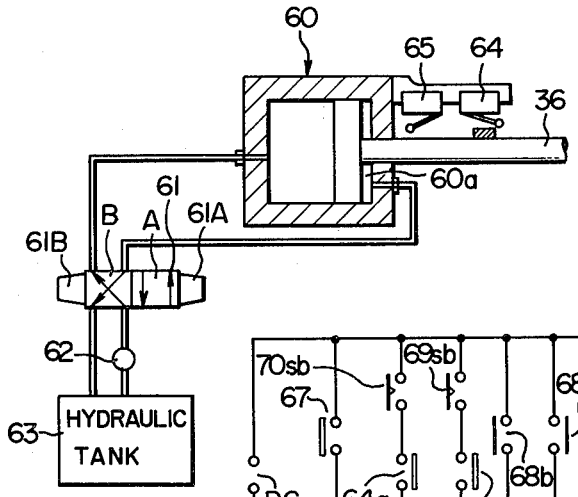
FIG. 3A is a schematic view of means, shown in its basic form, for automatically switching the speed increasing gear system from one speed increase ratio to another.
Figure 3B:
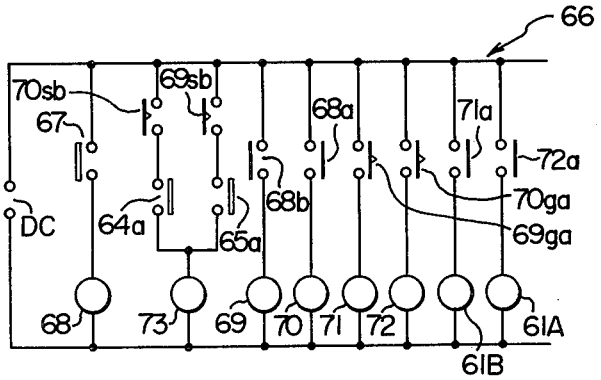
FIG. 3B is a diagram of a circuit for the means shown in FIG. 3A.

The aforesaid switching can be automatically effected by automatic speed increase ratio switching means shown in FIG. 3A. As shown in FIG. 3A, the automatic speed increase ratio switching means includes an actuator generally designated by the reference numeral 60 connected to the operating rod 36, an electromagnetic four-way valve 61, a hydraulic pump 61, a hydraulic tank 63, a relief mechanism, not shown, a limit switch 64 for detecting that the clutch 32 (for the lower speed increase ratio) is engaged, another limit switch 65 for detecting that the clutch 33 (for the higher speed increase ratio) is engaged, and an operating circuit generally designated by the reference numeral 66 shown in FIG. 3B. The operating circuit 66 includes a contact 67 which is open when the lower speed increase ratio is indicated by the speed increase ratio change-over indicator 59 and closed when the higher speed increase ratio is indicated thereby, a relay 68 which is turned on and off through the contact 67, a first timer 69 which is turned on and off through a normally closed contact 68*b* of relay 68, a second timer 60 which is turned on and off through a normally open contact 68*a* of relay 68, a relay 71 which is turned on and off through a normally open timed contact 69*ga* of first timer 69. A relay 72 which is turned on and off through a normally open timed contact 70*ga* of second timer 70, and a relay 73 which is turned on and off through a normally closed instantaneous contact 69*sb*, a normally open contact 65*a* of limit switch 65, a normally closed instantaneous contact 70*sb* of second timer 70 and a normally open contact 64*a* of limit switch 64. Relay 73 turns on and off an electromagnetic contact, not shown, for passing a current, and blocking the passing of a current, to the electric motor 29. Normally open contact 71*a* energizes a solenoid 61B to change the flow passage to B, and normally open contact 72*a* energizes a solenoid 61A to change the flow passage to A. In this specification, an instantaneous contact is one which operates when a timer is actuated and when a current is blocked (thereby restoring the timer to its original position), and a timed contact is one which operates after lapse of a predetermined time interval following actuation of a timer.

Production of a higher speed increase ratio indicating signal by the speed increase ratio change-over indicator 59 closes contact 67 which has been open up to the present. This energizes relay 68 to open normally closed contact 68*b* to thereby restore first timer 69 to its original position and, at the same time, to close normally open contact 58*a* to thereby actuate second timer 70. Actuation of second timer 70 opens normally closed instantaneous contact 70*sb* to de-energize relay 73, to interrupt the operation of the electric motor 29. At this time, limit switch 64 is turned on as shown in FIG. 3, while normally open contact 64*a* remains closed. After lapse of a predetermined time interval (during which rotation of the electric motor 29 is completely interrupted) following actuation of second timer 70, normally open timed contact 70*ga* is brought to a closed position, to thereby energize relay 72. This closes normally open contact 72*a* to energize solenoid 61A, to actuate the four-way valve 61 to being its flow passage into index with the flow passage A. This admits pressure fluid into a chamber 60*a* to withdraw (move leftwardly in FIG. 3A) the operating rod 36 from the gear box 16, so that the clutch 33 is engaged. Complete withdrawing of the operating rod 36 from the gear box 16 turns on limit switch 65 and closes normally open contact 65*a*. As aforesaid, first timer 69 is restored to its original position when contact 67 is closed. Thus normally closed instantaneous contact 69*sb* remains closed, so that relay 73 is energized as soon as normally open contact 65*a* is closed and the electric motor 29 is restarted. The speed increasing gear system 5 can be switched from the higher speed increase ratio to a lower speed increase ratio by a process similar to the process described hereinabove.

The operation of the embodiment of the invention described hereinabove will now be described. A current is passed to the electric motor 29 to start same and transmit its rotation by way of the speed increasing gear system 5 to the impeller 50 to rotate same. Rotation of the impeller 50 compresses the refrigerant in a gaseous state and delivers same to the condenser 3 where the refrigerant in a gaseous state is cooled by cooling water flowing through the bundle of heat transfer tubes 11, to be condensed and changed into a liquid state. The refrigerant in a liquid state has its pressure reduced by the pressure reducing means 2 until the pressure reaches an evaporating level, before flowing into the evaporator 1. The refrigerant in a liquid state is partly changed into a gaseous state when it has its pressure reduced by the pressure reducing means 2. The refrigerant composed of liquid refrigerant and gaseous refrigerant in mingling relation is vaporized in the evaporator 1. When vaporized, the refrigerant absorbs latent heat of evaporation from the heated medium which is cooled while flowing through the bundle of heat transfer tubes 6, to thereby cool the heated medium.

The refrigerant vaporized into a gaseous state is sucked into the impeller 50 to be compressed again in the turbocompressor 4.

While the apparatus is in operation or standing by before operation, the speed increase ratio change-over indicator 59 may indicate a speed increase ratio which is distinct from the currently adopted speed increase ratio. When this is the case, the speed increasing gear system 5 is switched to the indicated speed increase ratio indicated by the indicator 59. The process through which the switching is effected is described hereinabove, so that description thereof will be omitted. The apparatus provided with automatic speed increase ratio change-over means can have their operating condition or speed increase ratio automatically switched to a desired operating condition or a desired speed increase ratio if the operator merely pushes a button.

Although not described, a click clutch may be replaced by a hydraulically operated multi-plate clutch shown in FIGS. 2 and 3 of U.S. Ser. No. 937,806. When the last-mentioned clutch is used, the speed increasing gear system can be switched from one speed increase ratio to another without interrupting the operation of the electric motor 29.

From the foregoing description, it will be appreciated that according to the present invention housings of the electric motor 29, speed increasing gear system 5 and turbocompressor are connected together in such a manner that no rotary shafts extends outwardly of the respective housings, thereby avoiding leakage of the working fluid from the apparatus. Also, the speed increasing gear system 5 provided by the invention enables a suitable speed increase ratio to be selected to thereby control the number of revolutions of the impeller of the turbocompressor 4, so that the number of revolutions can be adjusted to an optimum level to accomplish the objects of the invention.

What is claimed is:

1. A hermetic turbo-refrigerator apparatus comprising:

a turbocompressor for raising a pressure of a refrigerant in a gaseous state in a predetermined level;

a condensor for cooling and at least condensing the refrigerant in a gaseous state having its pressure raised;

a pressure reducing means for reducing the pressure of the refrigerant changed into a liquid state from the gaseous state by condensation;

an evaporator vaporizing the refrigerant in the liquid state having its pressure reduced to thereby cool a refrigerant to be cooled;

an electric motor for driving an impeller of said turbocompressor;

a speed increasing gear system for increasing the number of revolutions of an output shaft of said electric motor when rotation of said output shaft is transmitted to said impeller, said speed increasing gear system being adapted to change the speed increase ratio at least in two stages, said speed increasing gear system comprises a gear box, at least one support means supported by said gear box, said support means including a cylindrical portion, a bearing mounted on an inner side of said cylindrical portion of said support means, at least two bearings mounted on an outer side of said cylindrical portion of said support means, said rotary shafts including a first shaft supporting the impeller of said turbocompressor rotatably journaled by said gear box through bearings, the second shaft rotatably journaled by said bearing mounted on the inner side of said cylindrical portion of said support means, at least two first gears coupled to said first shaft, and at least two second gears rotatably supported by said bearings mounted on the outer side of said cylindrical portion of said support means, said second gears being adapted to mesh with said first gears;

operating means for switching from outside the speed increasing gear system from one speed increase ratio to another;

a detector for detecting external conditions of the atmosphere in which said hermetic turbo-refrigerator apparatus is installed;

means for indicating an optimum speed increase ratio in accordance with the external conditions detected by said detector; and wherein housings of said turbocompressor, said speed increasing gear system and said electric motor are connected together in such a manner that the output shaft of said electric motor, rotary shafts of said speed increasing gear system including a shaft for supporting the impeller of said turbocompressor are arranged hermetically sealed in the respective housings to avoid a leakage of working fluid of the turbo-refrigerator to the outside.

2. A hermetic turbo-refrigerator apparatus as claimed in claim 1, further comprising means for automatically switching the speed increasing gear system to an optimum speed increase ratio suitable for the external conditions detected by said detector.

3. A hermetic turbo-refrigerator apparatus as claimed in claim 1 or 2, wherein said speed increasing gear system comprises two sets of gear trains for switching the speed increase gear ratio in two stages.

4. A hermetic turbo-refrigerator apparatus as claimed in claim 1 or 2, wherein said detector detects condensing pressure.

5. A hermetic turbo-refrigerator apparatus as claimed in claim 1 or 2, wherein said detector detects temperature.

6. A hermetic turbo-refrigerator apparatus as claimed in claim 5, wherein said detector detects the temperature of cooling water in the condenser.

7. A hermetic turbo-refrigerator apparatus as claimed in claim 5, wherein said detector detects the outdoor temperature.

8. A hermetic turbo-refrigerator apparatus comprising:

a turbocompressor for raising the pressure of the refrigerant in a gaseous state to a predetermined level;

a condensor for cooling and at least condensing the refrigerant in a gaseous state having its pressure raised;

a pressure reducing means for reducing the pressure of the refrigerant changed into a liquid state from the gaseous state by condensation;

a evaporator vaporizing the refrigerant in the liquid state having its pressure reduced to thereby cool the refrigerant to be cooled;

an electric motor for driving an impeller of said turbocompressor;

a speed increasing gear system for increasing the number of revolutions of an output shaft of said electric motor when rotation of said output shaft is transmitted to said impeller, said speed increasing gear system being adapted to change the speed increase ratio at least in two stages, said speed increasing gear system comprises a gear box, a first shaft and a second shaft located parallel to each other and rotatably supported in said gear box, at least two first gears rotatably supported by said first shaft, said two first gears being distinct from each other in pitch diameter, at least two second gears arranged concentrically with said second shaft and each in meshing engagement with one of said two first gears, clutch means for connecting one of said two second shafts to said second shaft for rotation unitarily therewith, at least two roller bearings each journalling one of said two second gears, and support means for rotatably supporting said second gears through said roller bearings, said support means being connected to said gear box and remaining stationary;

operating means for switching from outside the speed increasing gear system from one speed increase ratio to another;

a detector for detecting external conditions of the atmosphere in which said hermetic turbo-refrigerator apparatus is installed;

means for indicating an optimum speed increase ratio in accordance with the external conditions detected by said detector; and wherein housings of said turbocompressor, said speed increasing gear system and said electric motor are connected together in such a manner that the output shaft of said electric motor, rotary shafts of said speed increasing gear system including a shaft for supporting the impeller of said turbocompressor are hermetically sealed in the respective housings to avoid a leakage of working fluid of the turbo-refrigerator to the outside.

9. A hermetic turbo-refrigerator apparatus as claimed in claim 8, wherein said first shaft and said first gears are formed integrally.

10. A hermetic turbo-refrigerator apparatus as claimed in claim 8, wherein said gear box includes a bracket extending between the adjacent two second gears for supporting said support means.

11. A hermetic turbo-refrigerator apparatus as claimed in claim 8, wherein said support means comprises bearing means for rotatably journalling said second shaft.

12. A hermetic turbo-refrigerator apparatus comprising:

a turbocompressor for raising a pressure of a refrigerant in a gaseous state to a predetermined level;

a condensor for cooling and at least condensing the refrigerant in a gaseous state having its pressure raised;

pressure reducing means for reducing the pressure of refrigerant changed in a liquid state from the gaseous state by condensation;

an evaporator vaporizing the refrigerant in the liquid state having its pressure reduced to thereby cool the refrigerant to be cooled;

an electric motor for driving an impeller of said turbocompressor;

a speed increasing gear system for increasing the number of revolutions of an output shaft of said electric motor when rotation of said output shaft is transmitted to said impeller, said speed increasing gear system being adapted to change the speed increase ratio at least in two stages, said speed increasing gear system comprises a gear box, a first shaft and a second shaft located parallel to each other and rotatably supported in said gear box, at least two first gears rotatably supported by said first shaft, said two first gears being distinct from each other in pitch diameter, at least two second gears arranged concentrically with said second shaft and each in meshing engagement with one of said two first gears, clutch means for connecting one of said two gears to said second shaft for rotation unitarily therewith, at least two roller bearings each journalling one of said two second gears, and support means for rotatably supporting said second gears through said roller bearings, said support means being connected to said gear box and remaining stationary;

operating means for switching from outside the speed increasing gear system from one speed increase ratio to another;

a detector means for detecting external conditions of the atmosphere in which said hermetic turbo-refrigerator apparatus is installed;

means for indicating an optimum speed increase ratio in accordance with the external conditions detected by said detector;

means for automatically switching the speed increasing gear system to an optimum speed increase ratio suitable for the external conditions detected by said detector; and wherein housing of said turbocompressor, said speed increasing gear system and said electric motor are connected together in such a manner that the output shaft of said electric motor, rotary shafts of said speed increasing gear system including a shaft for supporting the impeller of said turbocompressor are hermetically sealed in the respective housings to avoid a leakage of working fluid of the turbo-refrigerator to the outside.

* * * * *